US008720012B2

(12) United States Patent
Leung

(10) Patent No.: US 8,720,012 B2
(45) Date of Patent: May 13, 2014

(54) FASTENER FOR DOCUMENT FOLDER

(76) Inventor: Ming-Fuk Leung, Mongkok (HK)

( * ) Notice: Subject to any disclaimer, the term of this patent is extended or adjusted under 35 U.S.C. 154(b) by 0 days.

(21) Appl. No.: 13/584,684

(22) Filed: Aug. 13, 2012

(65) Prior Publication Data

US 2013/0047383 A1 Feb. 28, 2013

(30) Foreign Application Priority Data

Aug. 29, 2011 (CN) ..... 2011 2 0317346

(51) Int. Cl.
*B42F 9/00* (2006.01)

(52) U.S. Cl.
USPC ..... 24/67.5; 24/67.11; 24/67.3

(58) Field of Classification Search
USPC ..... 281/21.1, 27.3, 45, 49, 51; 248/451, 248/452; 362/99; 24/10 R, 67.11, 67.3, 24/67.5, 67.7, 67 R
See application file for complete search history.

(56) References Cited

U.S. PATENT DOCUMENTS 598,368 A * 2/1898 Griffin ..... 24/67.3
2,273,584 A * 2/1942 Moore ..... 24/67.5
4,375,296 A * 3/1983 Chang ..... 281/45
4,645,163 A * 2/1987 Zovar ..... 248/452
D298,955 S * 12/1988 Zovar ..... D19/88
4,948,172 A * 8/1990 Chang ..... 281/45
4,961,249 A * 10/1990 Liu et al. ..... 24/67.3
6,217,075 B1 * 4/2001 Tsai ..... 281/45
7,032,274 B2 * 4/2006 Kumagai ..... 24/67 R
8,006,354 B2 * 8/2011 Cheng ..... 24/67.5
2002/0050028 A1 * 5/2002 Kumagai ..... 24/67.11
2008/0196211 A1 * 8/2008 Cheng ..... 24/67.7
2010/0084848 A1 * 4/2010 Nguyen ..... 281/49

* cited by examiner

*Primary Examiner* — Robert J Sandy
*Assistant Examiner* — Louis Mercado
(74) *Attorney, Agent, or Firm* — Jackson IPG PLLC

(57) ABSTRACT

A fastener for a document folder includes a base plate, a hook bracket and torsion springs. The front end of the base plate is extended upwards and curled to form a bending section. A slot is formed by the surrounding of the bending section. Rotating shafts on two sides of the front end of the hook bracket are respectively arranged at two ends of the inside of the slot. The torsion springs are respectively sleeved on the rotating shafts on two sides of the front end of the hook bracket. Some ends of the torsion springs are fixed on the rotating shafts and the other ends of the torsion springs are fixed on the base plate. End sections of the rotating shafts are bent upwards to form retaining sections. Clamp holes are engaged with the retaining sections and used for fastener opening formed on the front of the bending section.

16 Claims, 5 Drawing Sheets

FASTENER FOR DOCUMENT FOLDER

FIELD OF THE INVENTION

The invention relates to the technical field of clamping means, in particular to a fastener for a document folder.

BACKGROUND OF THE INVENTION

Document folders are widely used in office and study and frequently used in work. For example, the Chinese utility model Apl. No. 200720052528.9 titled "Document Folder" is provided. When a fastener for the document folder is opened, manpower is required for fastener opening and the state of fastener opening must be maintained. When the fastener for the document folder is closed, manpower is usually required for auxiliary and slow closing of the fastener so as to avoid the risk of pinching hand. In order to increase the clamping force of the fastener to the document folder, the torsional force of torsion springs fixed on rotating shafts of the fastener is larger. Therefore, when the state of fastener opening is maintained, a user can only use one hand to hold the fastener and the other hand to put documents in order, and thus the documents are usually out of order. When the fastener is closed, if the hand for holding the fastener is abruptly let go, a hook bracket of the fastener may revolve abruptly, and thus the other hand may be wounded due to the impact and holding of the hook bracket. The fastener for the document folder has the disadvantages that: when the fastener is opened, manpower is required for holding the fastener, and thus the sorting of the documents is inconvenient; and when the fastener is closed, the hands may be wounded.

SUMMARY OF THE INVENTION

The objective of the invention is to overcome the defects in the prior art and provide a fastener for a document folder, wherein when the fastener is opened, no hand is required for holding the fastener; and when the fastener is closed, no hand is required for pulling a hook body, and thus hands are prevented from being wounded due to clamping.

In order to achieve the objective, the invention adopts the technical proposal that:

The invention relates to a fastener for a document folder, which comprises a base plate, a hook bracket and torsion springs, wherein the front end of the base plate is extended upwards and curled to form a bending section; a slot is formed by the surrounding of the bending section; rotating shafts on two sides of the front end of the hook bracket are respectively arranged at two ends of the inside of the slot; the torsion springs are respectively sleeved on the rotating shafts on two sides of the front end of the hook bracket; one ends of the torsion springs are fixed on the rotating shafts and the other ends of the torsion springs are fixed on the base plate; end sections of the rotating shafts are bent upwards to form retaining sections; clamp holes engaged with the retaining sections and used for fastener opening are formed on the front of the bending section; when the hook bracket is turned up along with the rotation of the rotating shafts until the retaining sections of the rotating shafts rotate to the clamp holes, top ends of the retaining sections are extended out of the clamp hooks and the retaining sections are clamped with the clamp holes; and the upper part of the bending section is movably connected with a slider which is used for fastener closing and can slide along the surface of the bending section.

As preferred, through holes are formed at the upper end of the bending section and provided with joint pins; upper ends of the joint pins are fixedly connected with the slider; and central sections of the joint pins are in clearance fit with the through holes.

As preferred, the slider is provided with connecting holes engaged with the upper ends of the joint pins; and the upper ends of the joint pins are fixed in the connecting holes.

As preferred, the slider and the joint pins are integrated into a whole.

As preferred, stop blocks are formed at lower ends of the joint pins.

As preferred, the joint pins take the shape of an inverted T.

As preferred, the front end of the slider is extended downwards to form pressure fingers engaged with the retaining sections of the rotating shafts; and the pressure fingers are disposed on the clamp holes.

As preferred, the front end of the slider is extended onwards to form a pressure block convenient for hand pressing.

As preferred, a groove engaged with a curved plate is formed on the lower end face of the slider.

As preferred, the other ends of the torsion springs are extended outwards to form pins which lean against the lower end face of the base plate or the inner side face of the bending section.

As preferred, the central section of the base plate is convex upwards, and the pins of the torsion springs lean against the lower end face of the base plate.

The front end, the upper part, etc. illustrated in the invention all take the fastener for the document folder in the state of horizontal arrangement as illustrated in FIG. 1 as reference.

The invention has the advantages that: the invention relates to a fastener for a document folder, which comprises a base plate, a hook bracket and torsion springs, wherein the front end of the base plate is extended upwards and curled to form a bending section; a slot is formed by the surrounding of the bending section; rotating shafts on two sides of the front end of the hook bracket are respectively arranged at two ends of the inside of the slot; the torsion springs are respectively sleeved on the rotating shafts on two sides of the front end of the hook bracket; one ends of the torsion springs are fixed on the rotating shafts and the other ends of the torsion springs are fixed on the base plate; end sections of the rotating shafts are bent upwards to form retaining sections; clamp holes engaged with the retaining sections and used for fastener opening are formed on the front of the bending section; when the hook bracket is turned up along with the rotation of the rotating shafts until the retaining sections of the rotating shafts rotate to the clamp holes, top ends of the retaining sections are extended out of the clamp hooks and the retaining sections are clamped with the clamp holes; and the upper part of the bending section is movably connected with a slider which is used for fastener closing and can slide along the surface of the bending section. As the retaining sections are formed on the rotating shafts of the hook bracket and the corresponding clamp holes are formed on the bending section, the two processes of fastener opening and fastener closing of the hook bracket are independent of each other. After the fastener is opened through the hook bracket, the retaining sections are clamped in the clamp holes, and thus the hook bracket cannot revolve due to the torsional force of the torsion springs. Moreover, as the slider is arranged on the retaining sections and the pressure fingers of the slider are over against the retaining sections, when the fastener is required to be closed, only the pressure fingers of the slider are required for being pressed down to press the retaining sections into the clamp holes, and then the hook bracket will rotate counterclockwise under the action of the torsional force of the torsion springs until the fastener is closed. The fastener for the document folder has the advantages of simple structure and safety and practicality.

DETAILED DESCRIPTION OF THE PREFERRED EMBODIMENTS

Figure 1:
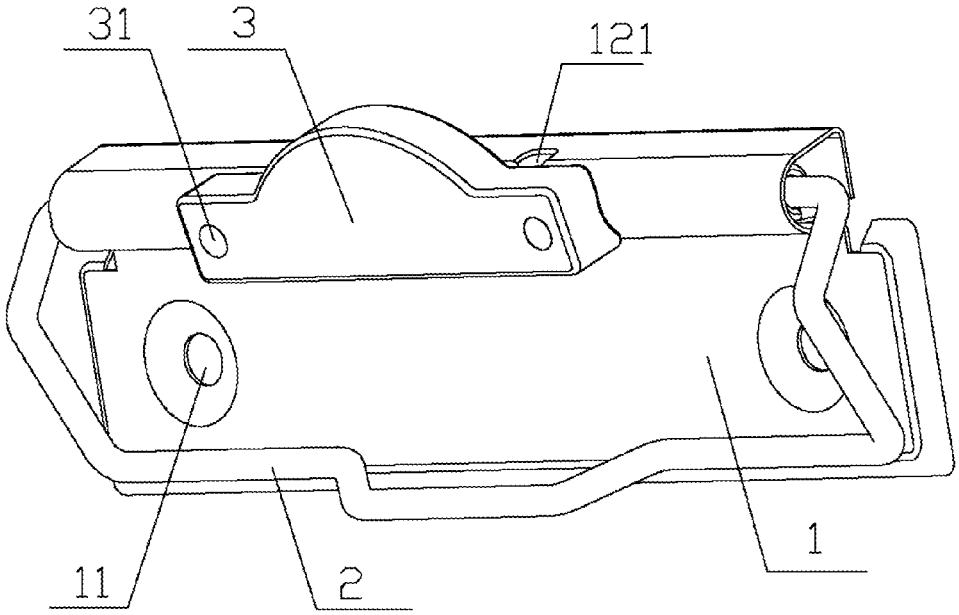
FIG. 1 is a structure diagram of the fastener for the document folder provided by the invention.
Figure 2:
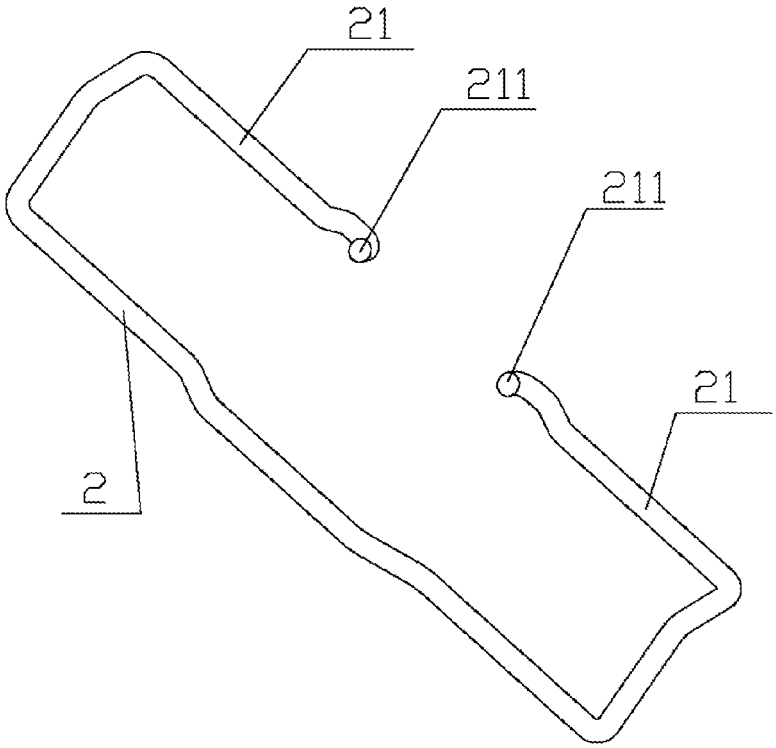
FIG. 2 is a structure diagram of a hook bracket of the fastener for the document folder provided by the invention.

Further description is given to the invention with the attached drawings and preferred embodiments.

Embodiment:

As illustrated in FIGS. 1 to 10, the invention relates to a fastener for a document folder, which comprises a base plate 1, a hook bracket 2 and torsion springs 5, wherein the front end of the base plate 1 is extended upwards and curled to form a bending section 12; a slot is formed by the surrounding of the bending section 12; rotating shafts 21 on two sides of the front end of the hook bracket 2 are respectively arranged at two ends of the inside of the slot; the torsion springs 5 are respectively sleeved on the rotating shafts 21 on two sides of the front end of the hook bracket 2; one ends of the torsion springs 5 are fixed on the rotating shafts 21 and the other ends of the torsion springs 5 are fixed on the base plate 1 or the bending section 12; end sections of the rotating shafts 21 are bend upwards to form retaining sections 211; clamp holes 121 engaged with the retaining sections 211 and used for fastener opening are formed on the front of the bending section 12; when the hook bracket 2 is turned up along with the rotation of the rotating shafts 21 until the retaining sections 211 of the rotating shafts 21 rotate to the clamp holes 121, top ends of the retaining sections 211 are extended out of the clamp holes 121 and the retaining sections 211 are clamped with the clamp holes 121; and the upper part of the bending section 12 is movably connected with a slider 3 which is used for fastener closing and can slide along the surface of the bending section 12.

When the fastener is used, the front end of the hook bracket 2 is pulled up relative to the base plate 1; the rotating shafts 21 at the front end of the hook bracket 2 rotate clockwise in the slot; and the torsion springs 5 fixedly connected with the rotating shafts 21 perform torsional movement. When the retaining sections 211 of the rotating shafts 21 move to the clamp holes 121, the top ends of the retaining sections 211 of the rotating shafts 21 are extended out of the clamp holes 121 and the hook bracket 2 is prevented from rotating. Herein, the state is fastener opening state. When the fastener is in the opening state, no manpower is required for controlling the fastener and hands can be released for sorting out documents, and thus the documents in the fastener can be conveniently put in order. After the documents are put in order, the front end of the slider 3 is pressed down. As the slider 3 is movably connected with a curved plate 123, the slider 3 slides forwards a distance, with the lower end face of the slider 3 attached to the upper end face of the bending section 12; the front ends of the retaining sections 211 of the rotating shafts 21 on two sides are pressed into the clamp holes 121 by the front end of the underside of the slider 3; and the rotating shafts 21 rotate counterclockwise under the action of the torsional force of the torsion springs 5 and drive the hook bracket 2 to turn down until the fastener is in the closing state. In the process, no hand assistance is required for putting down the hook bracket 2. Moreover, the risk of pinching hand is avoided and the fastener for the document folder is safe and convenient to operate.

Figure 3:
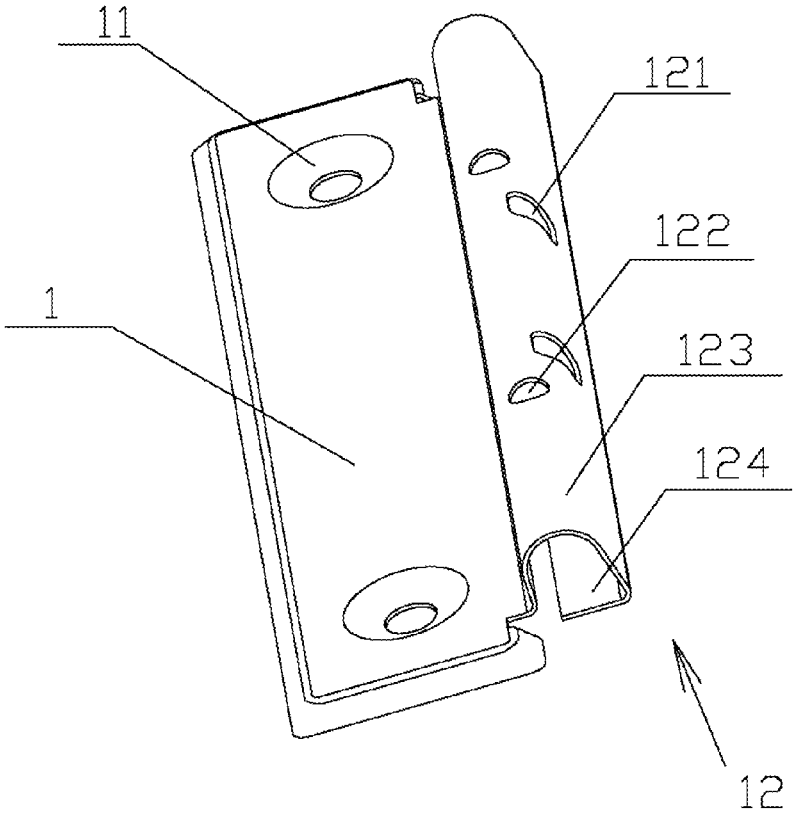
FIG. 3 is a structure diagram of a base plate of the fastener for the document folder provided by the invention.
Figure 9:
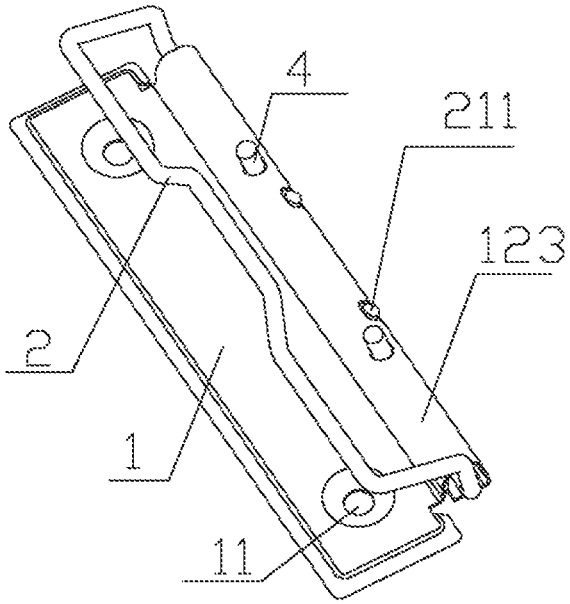
FIG. 9 is a schematic diagram of FIG. 8 seen from another angle of view after the slider is removed.

Wherein, through holes 122 are formed at the upper end of the bending section 12 and provided with joint pins 4; upper ends of the joint pins 4 are fixedly connected with the slider 3; and central sections of the joint pins 4 are in clearance fit with the through holes 122 (as illustrated in FIGS. 3 and 9).

The slider 3 is slideably connected to the upper part of the bending section 12 through the joint pins 4. As the central sections of the joint pins 4 are in clearance fit with the through holes 122, the joint pins 4 can rotate back and forth in the through holes 122, and thus the slider 3 can slide back and forth along the upper end face of the bending section 12, and consequently the process that the slider 3 drives the retaining sections 211 of the rotating shafts 21 to enter into the clamp holes 121 can be realized.

Figure 4:
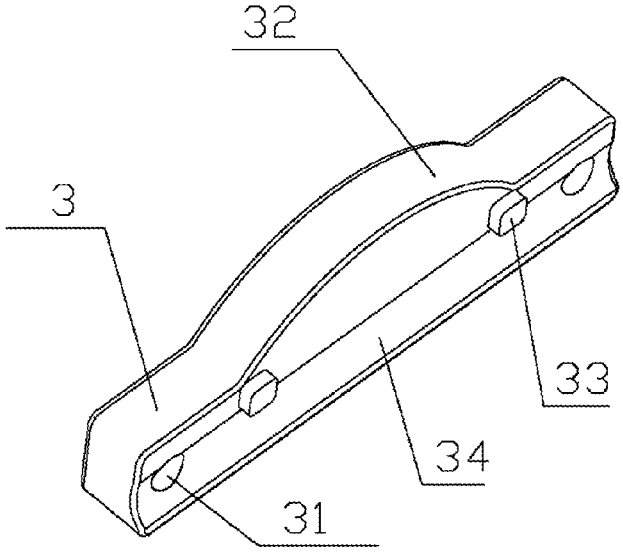
FIG. 4 is a structure diagram of a slider of the fastener for the document folder provided by the invention.

Moreover, the slider 3 is provided with connecting holes 31 engaged with the upper ends of the joint pins 4, and the upper ends of the joint pins 4 are fixed in the connecting holes 31 (as illustrated in FIG. 4).

Figure 5:
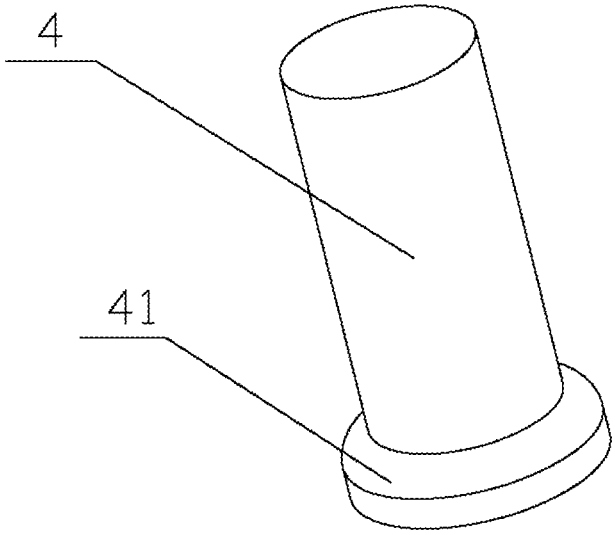
FIG. 5 is a structure diagram of a joint pin of the fastener for the document folder provided by the invention.

Furthermore, stop blocks 41 are formed at lower ends of the joint pins 4 (as illustrated in FIG. 5).

After the stop blocks 41 are formed at the lower ends of the joint pins 4, the dimension of the lower ends of the joint pins 4 is more than that of the through holes 122 of the curved plate 123, and thus the joint pins 4 are prevented from being dropped from the curved plate 123 after the lower ends of the joint pins 4 are clamped in the slot.

Figure 10:
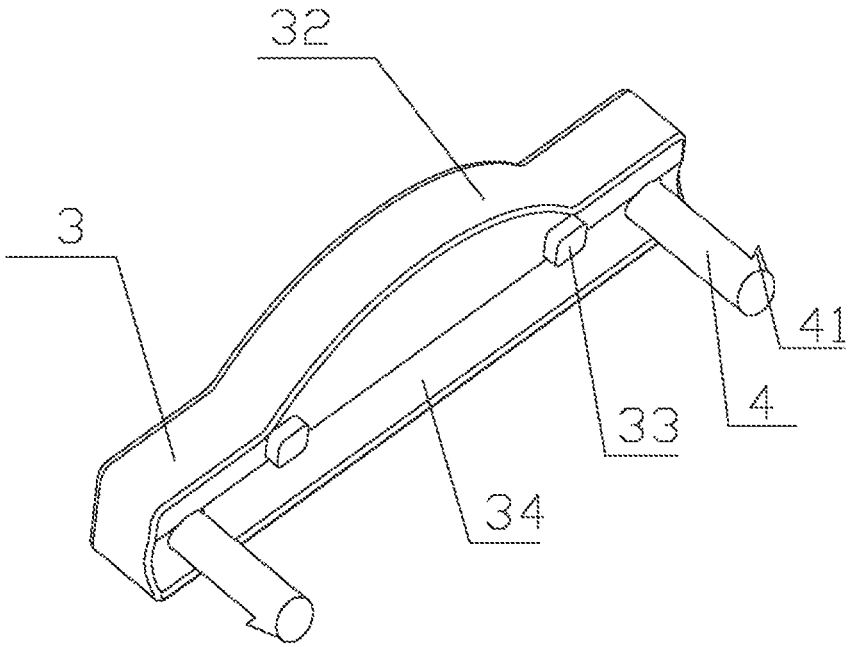
FIG. 10 is another structure diagram of the slider of the fastener for the document folder provided by the invention.

As a variation of the embodiment, the slider 3 and the joint pins 4 are integrated into a whole (as illustrated in FIG. 10), namely the underside of the slider 3 is extended downwards to form the joint pins 4. As the slider 3 and the joint pins 4 are integrated into a whole, the number of components and parts of the fastener is reduced, and thus the cost is reduced. Moreover, during the use, the loose connection between the slider 3 and the joint pins 4 can be avoided.

As another variation of the embodiment, a fixture block is formed at the lower end of the slider 3; the bending section 12 is provided with a slotted hole engaged with the fixture block and used for moving the fixture block; the fixture block at the lower end of the slider 3 is clamped into the slotted hole and the slider 3 is attached to the upper end face of the bending section 12 and slides along the slot, and thus the retaining sections 211 can be pressed down; and the fixture block can take the shape of an inverted T, an L and the like.

Still furthermore, the joint pins take the shape of an inverted T.

The joint pins 4 are T-shaped plastic rods of which tail ends pass through the slider 3 and the through holes 122 on the curved plate 123 respectively and are then subjected to heating deformation, and then the slider 3 is riveted on the curved plate 123.

As a variation of the embodiment, the joint pins can take the shape of an L and the like.

Wherein, the front end of the slider 3 is extended downwards to form pressure fingers 33 engaged with the retaining sections 211 of the rotating shafts 21; the pressure fingers 33 are disposed on the clamp holes 121; and the front end face of the slider 3 is extended forwards to form a pressure block 32 convenient for hand pressing.

The pressure fingers 33 are formed at the front end of the slider 3 and disposed on the clamp holes 121. That is to say, when the fastener is in the opening state, the pressure fingers 33 are disposed on the retaining sections 211; and the retaining sections 211 can be pressed into the clamp holes 121 only by being slightly pressed down by the pressure fingers 33, and the slider 3 is not required to move for a long distance. Therefore, when the joint pins 4 are designed to be engaged with the through holes 122 of the bending section 12, the dimension of the through holes 122 of the bending section 12 can be designed to be slightly small, so that the retaining sections 211 can be conveniently pressed into the clamp holes 121 by the slider 3.

The pressure block 32 which is convex forwards is formed on the front end face of the slider 3. When the fastener is in the opening state, the slider 3 can rotate forwards for a certain range along with the joint pins 4 only by using a hand to press down the pressure block 32. Due to the design of the pressure block 32, the hand pressing is convenient. Moreover, the distance from a hand pressing position to the joint pins 4 is longer, and thus the labor can be saved during the hand pressing and the fastener for the document folder is applied to children.

Moreover, in the embodiment, the bending section 12 comprises the curved plate and a flat plate, wherein the lower end face of the flat plate is level with the underside of the base plate 1, and the bending section 12 can also be a tube body of which the cross section takes the shape of an open loop.

Furthermore, the curved plate 123 is provided with at least two through holes 122 used for the mounting of the slider 3, and the slider 3 is movably connected with the curved plate 123 through at least two joint pins 4. In the embodiment, the curved plate 123 is provided with two through holes 122 used for the mounting of the slider 3, and the slider 3 is movably connected with the curved plate 123 through two joint pins 4.

The slider 3 is movably connected with the curved plate 123 through more than two joint pins 4. Therefore, the phenomena that the pressure fingers 33 of the slider 3 are deviated from the position and cannot have the function of pressing the retaining sections 211 of the rotating shafts 21 into the clamp holes 121 as the slider 3 can rotate around the joint pin 4 when one joint pin 4 is used for fixing the slider 3 can be avoided.

Figure 6:
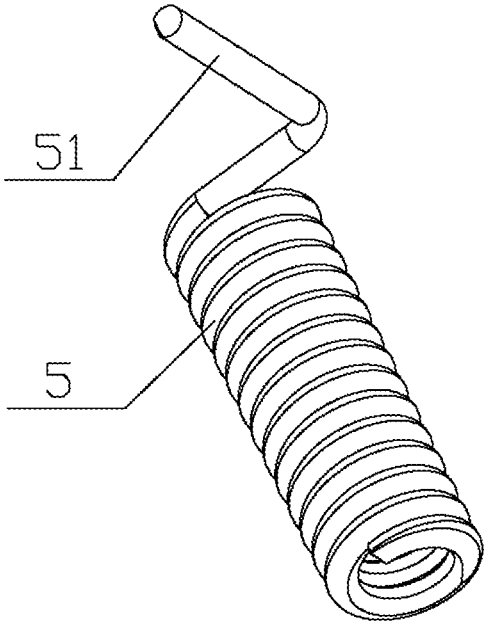
FIG. 6 is a structure diagram of a torsion spring of the fastener for the document folder provided by the invention.
Figure 7:
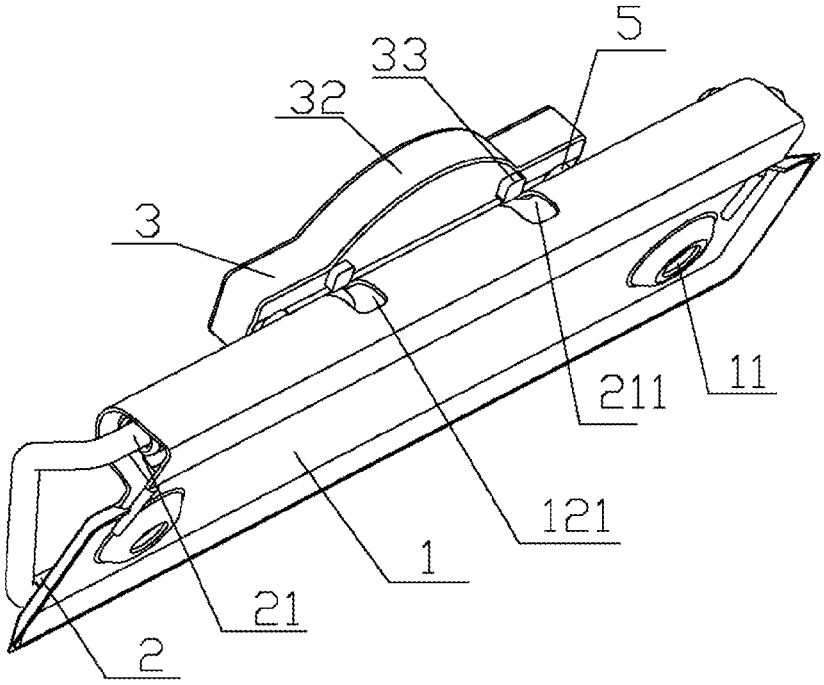
FIG. 7 is a structure diagram of the fastener for the document folder provided by the invention, in the closing state.
Figure 8:
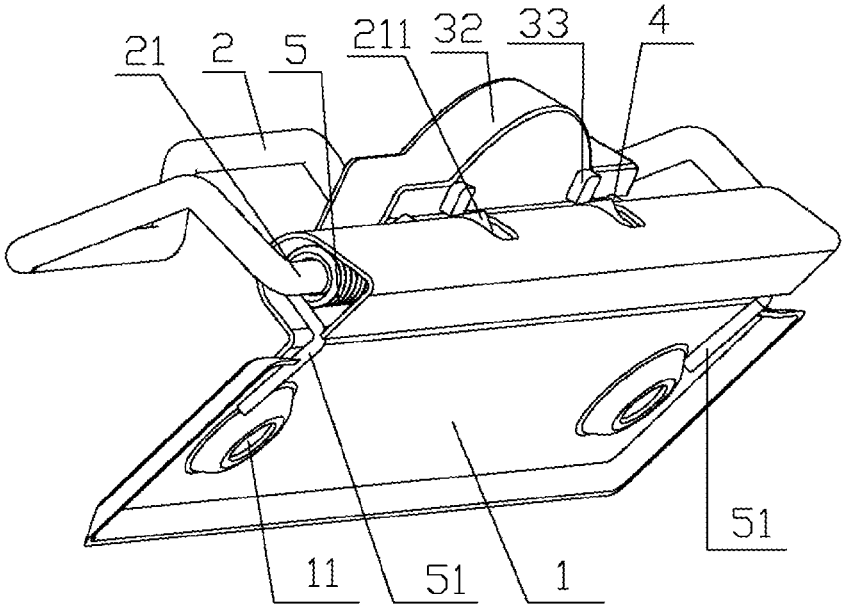
FIG. 8 is a structure diagram of the fastener for the document folder provided by the invention, in the opening state.

As preferred, the other ends of the torsion springs 5 are extended outwards to form pins 51 which lean against the lower end face of the base plate 1 or the inner side face of the bending section 12 (as illustrated in FIGS. 6 and 8).

The pins 51 are formed at the other ends of the torsion springs 5 and lean against the lower end face of the base plate 1 or the inner side face of the bending section 12 under the action of the torsional force of the torsion springs 5. As the torsional force is large, the other ends of the torsion springs 5 can be conveniently fixed without external fixing parts or devices.

Moreover, mounting holes 11 are respectively formed at two ends of the base plate 1 (as illustrated in FIG. 3).

The fastener can be fixed on the document folder through the mounting holes 11.

Furthermore, the central section of the base plate 1 is convex upwards, and the pins 51 of the torsion springs 5 lean against the lower end face of the base plate 1.

The base plate 1 can be formed by impact molding, and the central section of the base plate 1 is convex upwards. A space is formed by the central section, the left side, the right side and the rear side of the base plate 1 and can receive the pins 51 of the torsion springs 5 and the mounting holes 11, formed by impact molding, on the base plate 1, so that the phenomenon that the pins 51 of the torsion springs 5 are protruded out of the lower end face on one side of the base plate 1 can be avoided. The left side, the right side and the rear side of the base plate 1 and the lower end face of the flat plate 124 of the bending section 12 are all in the same plane, so that the fastener can be stably fixed on the document folder.

Still furthermore, a groove 34 engaged with the curved plate 123 is formed on the lower end face of the slider 3.

Due to the arrangement of the groove 34, the lower end face of the slider 3 can be attached to the upper end face of the curved plate 123, so that the contact area can be increased, and thus the slider 3 can be favorably, stably and slideably connected to the curved plate 123.

Detailed description is given to the invention. It should be understood by those skilled in the art that modifications or equivalent replacements can be made to the technical proposal of the invention without departing from the essence and scope of the technical proposal of the invention.

What is claimed is:

1. A fastener for a document folder, comprising:

a base plate, a hook bracket and torsion springs, wherein a front end of the base plate is extended upwards and curled to form a bending section;

a slot formed by the bending section;

rotating shafts on two sides of a front end of the hook bracket respectively arranged at two ends are inside of the slot;

the torsion springs respectively sleeved on the rotating shafts on two sides of the front end of the hook bracket;

ends of the torsion springs are fixed on the rotating shafts and other ends of the torsion springs are fixed on the base plate;

end sections of the rotating shafts bent upwards to form retaining sections;

clamp holes engaged with the retaining sections and used for opening the fastener formed on a front of the bending section;

when the hook bracket turned up along with a rotation of the rotating shafts until the retaining sections of the rotating shafts driven to rotate to the clamp holes, top ends of the retaining sections extended out of the clamp holes and the retaining sections clamped with the clamp holes; and an upper part of the bending section movably connected with a slider used for closing the fastener and capable of sliding along a surface of the bending section.

2. The fastener for the document folder according to claim 1, wherein a front end of the slider is extended onwards to form a pressure block convenient for hand pressing.

3. The fastener for the document folder according to claim 2, wherein a groove engaged with a curved plate of the bending section is formed on a lower end face of the slider.

4. The fastener for the document folder according to claim 1, wherein through holes are formed at an upper end of the bending section and provided with joint pins;

upper ends of the joint pins are fixedly connected with the slider; and central sections of the joint pins are in clearance fit with the through holes.

5. The fastener for the document folder according to claim 4, wherein stop blocks are formed at lower ends of the joint pins.

6. The fastener for the document folder according to claim 5, wherein the joint pins take a shape of an inverted T.

7. The fastener for the document folder according to claim 4, wherein the slider is provided with connecting holes engaged with the upper ends of the joint pins; and the upper ends of the joint pins are fixed in the connecting holes.

8. The fastener for the document folder according to claim 7, wherein stop blocks are formed at lower ends of the joint pins.

9. The fastener for the document folder according to claim 8, wherein the joint pins take a shape of an inverted T.

10. The fastener for the document folder according to claim 4, wherein the slider and the joint pins are integrated into a whole.

11. The fastener for the document folder according to claim 10, wherein stop blocks are formed at lower ends of the joint pins.

12. The fastener for the document folder according to claim 11, wherein the joint pins take a shape of an inverted T.

13. The fastener for the document folder according to claim 1, wherein a front end of the slider is extended downwards to form pressure fingers engaged with the retaining sections of the rotating shafts; and the pressure fingers are disposed on the clamp holes.

14. The fastener for the document folder according to claim 13, wherein the front end of the slider is extended onwards to form a pressure block convenient for hand pressing.

15. The fastener for the document folder according to claim 14, wherein a groove engaged with a curved plate of the bending section is formed on a lower end face of the slider.

16. The fastener for the document folder according to claim 1, wherein the other ends of the torsion springs are extended outwards to form pins which lean against a lower end face of the base plate or an inner side face of the bending section.

* * * * *